United States Patent [19]

Saetre et al.

[11] Patent Number: 4,502,596

[45] Date of Patent: Mar. 5, 1985

[54] GAME CARTRIDGE DISPLAY AND CARRIER PACK

[76] Inventors: Raymond L. Saetre, Rte. 1, Box 143, Bangor, Wis. 54614; Robert S. Saetre, Rte. 2, Box 841, Astoria, Oreg. 97103

[21] Appl. No.: 557,485

[22] Filed: Dec. 2, 1983

[51] Int. Cl.[3] ..... B65D 85/672

[52] U.S. Cl. ..... 206/387; 206/444; 206/466; 206/820; 229/69; 383/37; 383/122

[58] Field of Search ..... 206/387, 444, 456, 462, 206/466, 820; 383/37, 122; 150/34; 229/69

[56] References Cited

U.S. PATENT DOCUMENTS

| | | | |
|---|---|---|---|
| 1,115,229 | 10/1914 | Miller | 229/69 |
| 1,386,398 | 8/1921 | Davis | 206/820 |
| 1,565,389 | 12/1925 | Peacock | 150/34 |
| 1,827,466 | 10/1931 | Gilbert | 150/34 |
| 2,869,604 | 1/1959 | Fitzsimmons | 150/39 |
| 3,033,257 | 5/1962 | Weber | 383/37 |
| 3,332,548 | 7/1967 | Piazze et al. | 206/820 |
| 4,311,268 | 1/1982 | Soliren | 229/52 B |

FOREIGN PATENT DOCUMENTS

| | | | |
|---|---|---|---|
| 782910 | 4/1968 | Canada | 206/820 |
| 613659 | 11/1926 | France | 150/34 |
| 1548768 | 12/1968 | France | 206/820 |

*Primary Examiner*—William T. Dixson, Jr.
*Assistant Examiner*—Brenda J. Ehrhardt
*Attorney, Agent, or Firm*—Cook, Wetzel & Egan, Ltd.

[57] ABSTRACT

A display and storage pack, as for video game cartridges, is made of folded, flexible, sheet-form plastic. Side-by-side pockets are spaced along the length of the plastic by heat-sealed seams and hinge areas. The game cartridges have a substantial thickness, so the seams do not extend to the folded, bottom edges of the pockets but stop above such edges. The plastic then can accommodate the thickness of the cartridges without stretching or tearing. Cartridges are held firmly in the pockets by friction with the plastic, yet then can be easily inserted and removed. The pack is entirely flat when empty, and folds compactly, accordion-like, when entirely or partially filled. An elastic band affixed to a tab on one end of the pack holds it in its folded position. Handles allow carriage or hanging storage of the folded pack. When the pack is open the game cartridges are displayed for selection.

9 Claims, 6 Drawing Figures

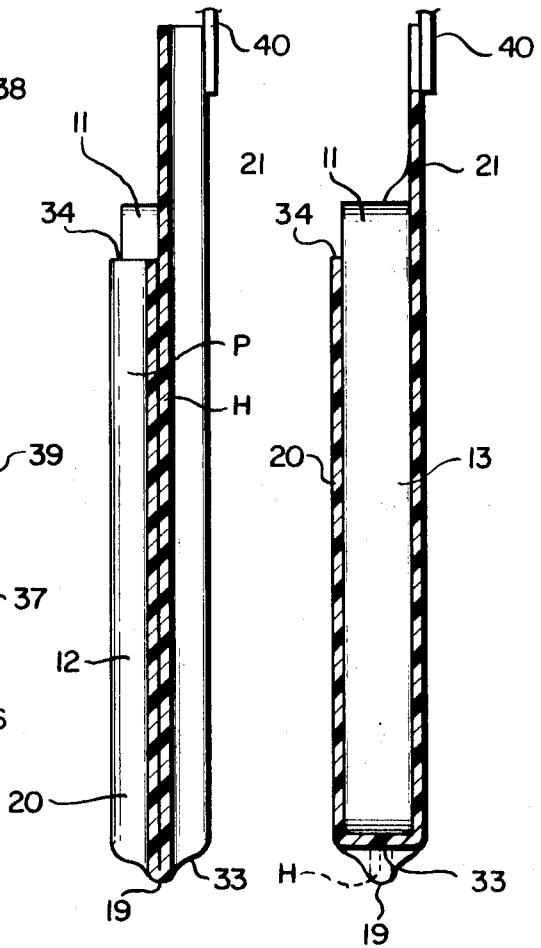
FIG. 5
FIG. 6
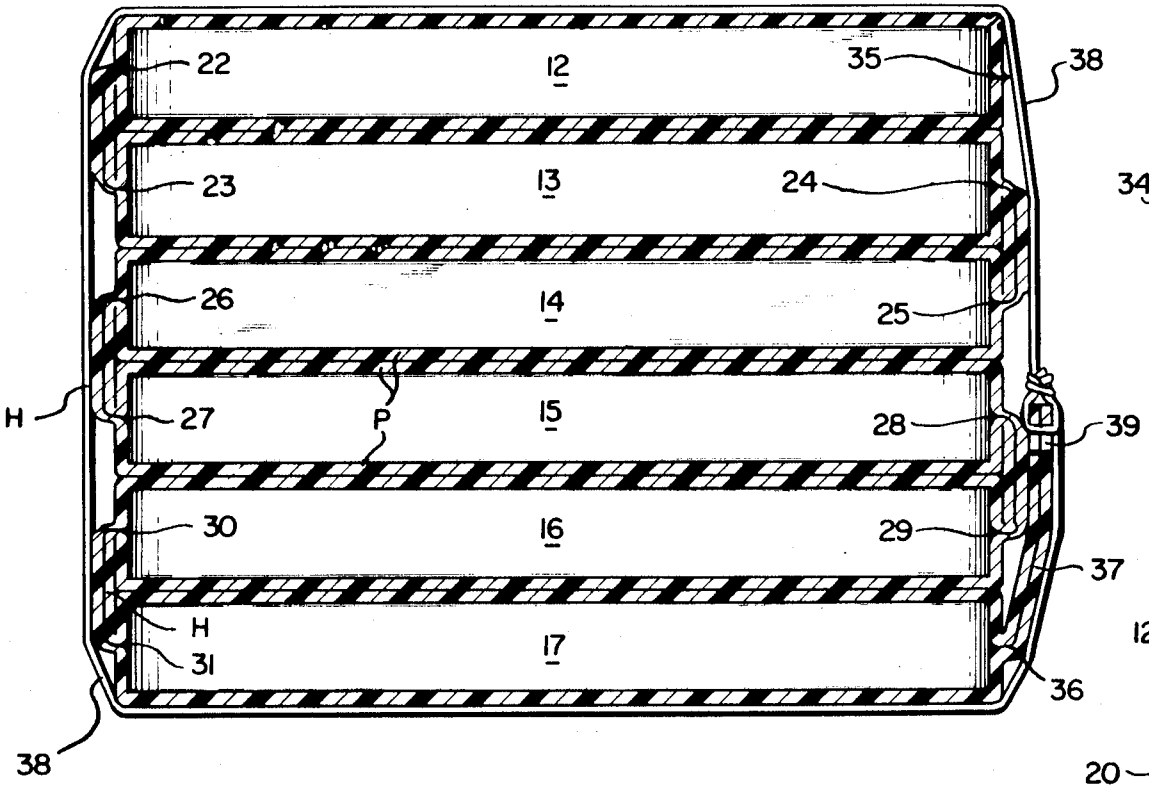
FIG. 3
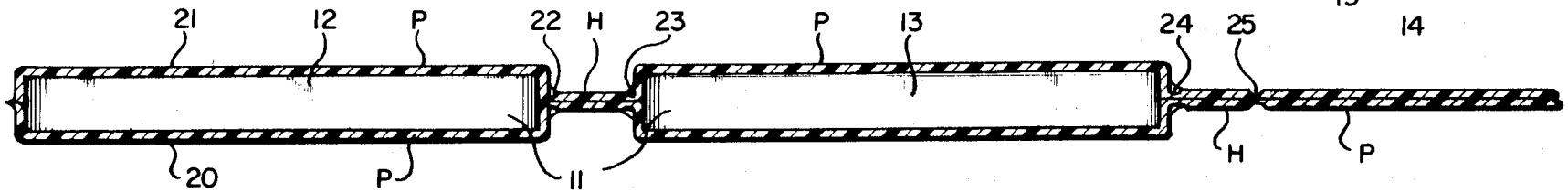
FIG. 4

GAME CARTRIDGE DISPLAY AND CARRIER PACK

The present invention relates to folding packs for displaying, carrying, and storing rectangular articles, particularly video game cartridges, which have substantial thickness.

Many devices are known for storing cards, licenses, photos, and other thin and flat rectangular articles, such as are shown in U.S. Pat. Nos. 1,827,466, 3,334,667, and 4,237,947. Although accumulations of cards and the like in individual pockets of such devices may become appreciable, the individual pockets can normally have only one or two cards, etc. slipped into them; if more items are slipped in, the cards jam together and the pockets can stretch and tear. U.S. Pat. No. 2,869,604 shows a holder for road maps. Such maps when folded have some thickness of folded papers, which thickness apparently is accommodated in the map holder by making the pockets oversized in width. The specification of the '604 patent states that each pocket can hold one or more maps, but does not indicate the thickness of the maps when folded. Storage packs or devices for articles having substantial thickness generally do not accordian-fold, but may be rolled, as is the map holder of the '604 patent above.

In summary, the present invention comprises a folding pack having a series of side-by-side pockets, each of which receives an individual article of substantial thickness and width for display and storage. The folding pack is made of flexible, clear plastic sheet material with pockets formed therein by making heat-sealed seams along selected lines. The seams do not extend to the folded bottom edge of the pack, but stop short thereof so that the plastic material of the pack can accommodate the thickness of the items stored in the pockets. The seams are provided in equally-spaced pairs which form narrow hinge panels between the pockets to accommodate the thickness of the articles for easy, accordian-folding.

In the drawings,

FIG. 3 is a horizontal sectional view through the folded pack, taken on line 3—3 of FIG. 2;

FIG. 4 is a sectional view of a portion of the unfolded pack of FIG. 1, taken on line 4—4;

FIG. 5 is a side, partly sectional view through one pocket of the carrier pack, with a game cartridge therein; and FIG. 6 is a side, partly sectional view of the edge of a pocket with a game cartridge therein, taken on line 6—6 of FIG. 1.

Figure 1:
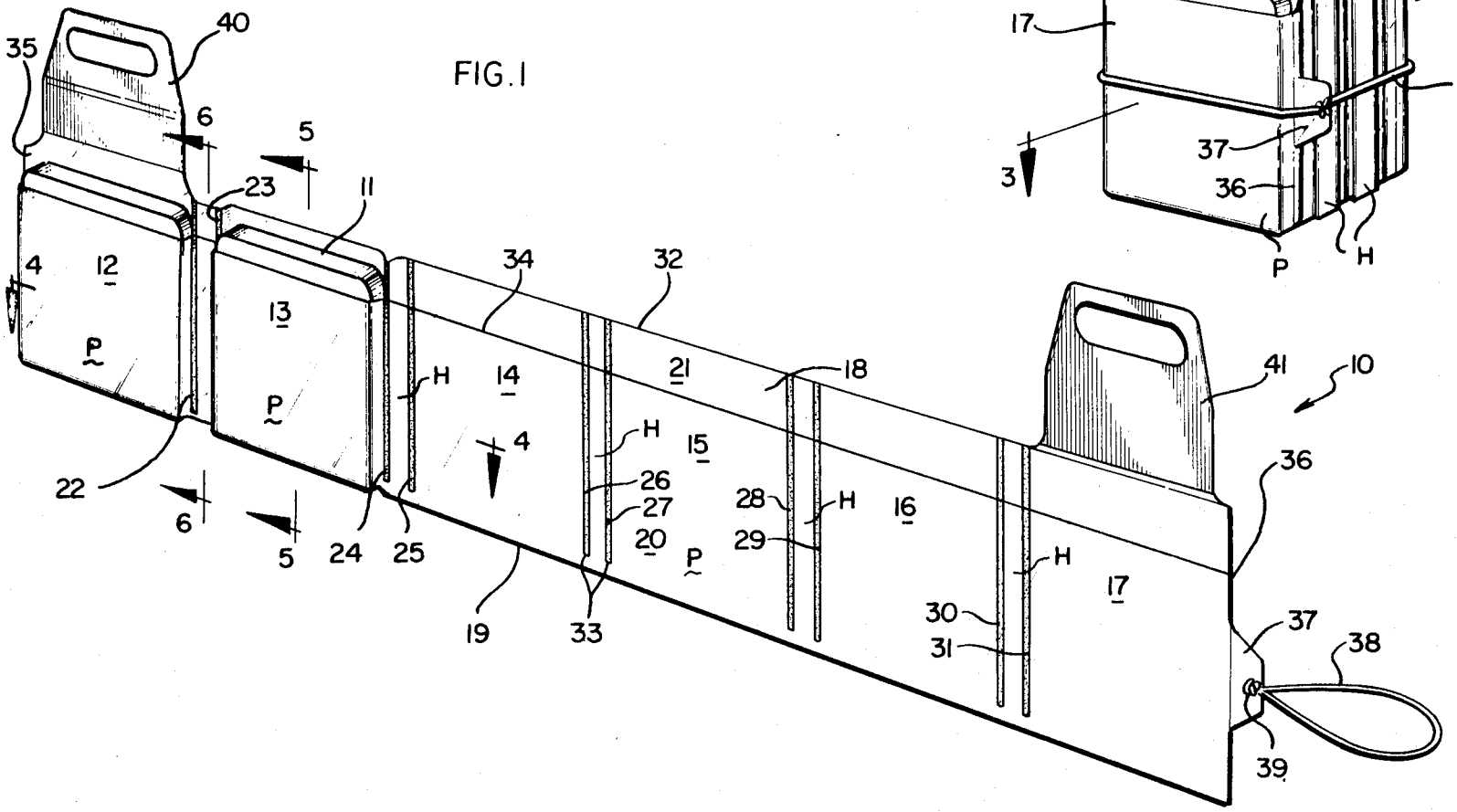
FIG. 1 is a general, perspective view of a carrier pack of the present invention, with two of six pockets occupied by game cartridges.

A game cartridge storage and carrier pack according to the present invention, in one embodiment, is shown in the drawing figures at 10. In FIG. 1, the pack 10 is completely unfolded for display of a plurality of rectangular solids such as, in particular, video game cartridges 11. Each cartridge 11 has a substantial thickness as compared to its width and height. Each rectangular solid or cartridge 11 is contained within one of a plurality of pockets 12, 13, 14, 15, 16, and 17 formed in a clear, flexible, sheet-form material 18. The pack 10 lies flat when empty and unfolded as in FIG. 1, for convenient shipping and storage.

The pockets 12–17 are formed in the carrier pack 10 by folding the material 13 over at a lower edge 19 to form front and rear walls 20, 21, respectively. The plurality of pockets 12–17 are further defined by equally spaced-apart pairs of heat-sealing seams 22, 23; 24, 25; 26, 27; 28, 29; and 30, 31 impressed in the sheet-form material 18, each extending from an upper edge 32 of the pack 10 to points or a line 33 adjacent but spaced above the lower edge 19. The heat-sealing lines 22–31 divide the walls 20, 21 into alternating panels P and H which form pockets and hinge areas between the pockets.

In one embodiment, in which the pack 10 extends $4\frac{7}{8}$ inches from the uppermost edge 32 to the lower, folded edge 19, the heat sealed seams 22-31 stop at points 33 which are spaced about $\frac{1}{4}$th inch above the lower edge 19. Further, the heat sealed seams 22–31 are about 1/16th inch wide, and the seams defining the adjacent pockets 12–17 are 4 inches apart between centers of the seams, across panels P. The seams of each pair are spaced about 7/16ths inch apart on center, across panels H.

Rather than using spaced-apart, narrow, heat-sealed seams, the plastic material on and between the edges of the seams of each pair 22, 23; etc. above the line 33 can be wholly bonded facially together, so that the walls 20, 21 become a single sheet in the hinge panels H between the edges of the bounded area. An upper edge 34 of the front wall 20 of each pocket 12–17 is spaced $3\frac{3}{4}$ inches above the lower edge 19, or 1 inch below the upper edge 32 of the rear wall 21. The upper edge 32 also is preferably crimped by a heat seal, to strengthen the material, although the edge 34 need not be.

Figure 2:
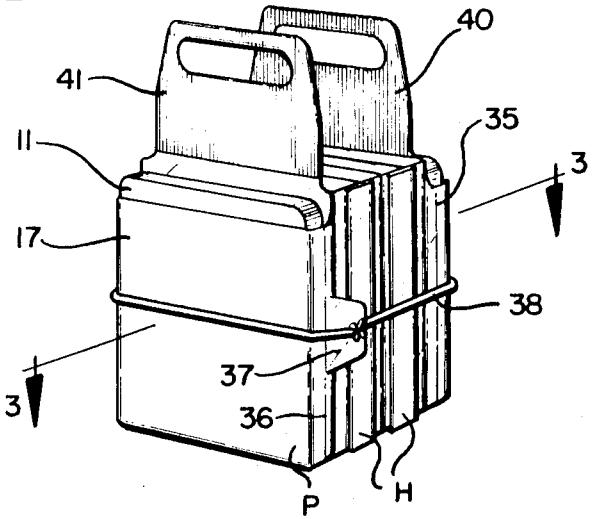
FIG. 2 is a general, perspective view of a filled game cartridge pack, folded and bound for carrying or storage.

Opposite ends 35 and 36 of the pack 10 are sealed to form the end pockets 12 and 17 and to sever the material 13. A tab 37 is formed on the end 36 by applying heat to the sheet-form material 18 to adhere the front and rear walls 20, 21 together. An elastic band 38 is attached to an aperture 39 formed in the tab 37. The band 38 is used to surround and hold the pack 10 in a compact position, as shown in FIG. 2. A pair of handles 40, 41 which preferably are an opaque plastic, are heat-sealed to the sheet form material 13 adjacent the upper edges of the end pockets 12, 17, for convenient carrying and hanging storage of the pack 10 and cartridges 11.

The pack 10 when empty is conveniently stored and shipped flat; it then occupies only the thickness of its two plastic walls. In use, the pockets 12 have inserted into them, between the front wall upper edge 34 and the rear wall upper edge 32, game cartridges 11 or similar rectangular solids of substantial thickness. The panels P of the front and rear walls 20, 21 of the material 13 are then separated by the thickness of the cartridges 11, as shown in drawing FIGS. 3 through 5. The material 13 closely surrounds the walls and edges of the cartridges 11 at front, rear, side, and bottom edges thereof.

The thickness of each game cartridge 11 displaces the plastic material 13 at the lower edge 19 and across the front and rear walls 20, 21 in panels P between the spaced pairs of seams 35, 22; 23, 24; 25, 26; etc. The displacement is accommodated without stretching or tearing of the plastic material 13. Both the flexibility of such material 13 and the ability of the material 13 along the fold line 19 beneath the lower ends 33 of the heat-sealed seams 22–31 to open to the required degree effectively shift material from the hinge panel areas H between and below the seams 22, 23; 24, 25; etc. to accommodate the thickness of the cartridges 11.

The seams 22–31 maintain the symmetry of the front and rear portions of the sheet material 18 to keep the seams near the centers of the side edges of the cartridges 11, as shown in FIG. 4. When the pack 10 is then accordian-folded, as indicated in FIGS. 2 and 3, the material of panels H between the heat sealed seams of each adjacent pair 22, 23; 24, 25; etc. spans the thickness of the cartridges to allow the material 13 to fold at the vertical edges of each seam 22–31. The pack 10 is accordian-folded, rather than being rolled or otherwise folded, so that the convenient pack of FIGS. 2 and 3 is provided.

The elastic band 38 affixed to the tab 37 is wrapped about the pack 10 to maintain it as a compact solid as shown in FIGS. 2 and 3, for convenient carrying and storage. Because the material of the pack is formed specifically to accommodate the thickness of the game cartridges 11, the cartridges are held firmly to prevent accidental dislodging, but nonetheless are easy to remove and to insert.

Although various minor modifications may be developed by those appreciating the merits of the present invention, all such modifications as come within the scope of the appended claims are within the scope of the present invention.

We claim as our invention:

1. A display and storage pack comprising a flexible, sheet-form material having front and rear walls forming a plurality of pockets in side-by-side adjacency, the pockets and the walls being connected together vertically at side edges of the pockets for selected accordian-folding, the pockets further being adapted to receive rectangular solids therein for display and storage, wherein the flexible sheet-form material is formed with pairs of evenly spaced-apart vertical seam edges located between and defining sides of adjacent ones of said pockets, and wherein lower ends of the vertical seam edges are normally spaced above the bottoms of the pockets on the sheet-form material by approximately half the thickness of said rectangular solids.

2. A pack as defined in claim 1, wherein the sheet-form material is folded along the bottoms of the pockets to form said front and rear walls.

3. A pack as defined in claim 1, wherein the seam edges are formed by heat-sealing of the front and rear walls.

4. A pack as defined in claim 1, further comprising a handle connected with said sheet-form material.

5. A pack as defined in claim 1, further comprising an elastic band affixed to one end of the sheet-form material and adapted to be extended around the pack in its accordian-folded position.

6. A pack for display and storage of game cartridges, the cartridges being rectangular solids of substantial thickness, the pack having a series of interconnected pockets and comprising:

front and rear walls of sheet-form material joined together at a lower edge and also along regularly spaced-apart pairs of seam edges which extend transversely to said lower edge from points spaced from said lower edge by about half the thickness of said cartridges, and wherein spaces between seam edges of each pair form hinges for accordian-folding of the pack when the pockets are filled with cartridges.

7. A pack as defined in claim 6, further comprising a handle attached to one of the front and rear walls.

8. A pack as defined in claim 6, further comprising an elastic band means affixed to one end of said pack for wrapping about the pack to hold said pack in an accordion-folded position for storage.

9. A pack as defined in claim 6, wherein the sheet-form material is a clear, flexible plastic.

* * * * *